US008984779B2

(12) United States Patent
Knuth

(10) Patent No.: US 8,984,779 B2
(45) Date of Patent: Mar. 24, 2015

(54) SHOVEL WITH PASSIVE TILT CONTROL

(71) Applicant: Harnischfeger Technologies, Inc., Wilmington, DE (US)

(72) Inventor: Jason Knuth, Brookfield, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 120 days.

(21) Appl. No.: 13/755,179

(22) Filed: Jan. 31, 2013

(65) Prior Publication Data

US 2013/0195593 A1 Aug. 1, 2013

Related U.S. Application Data

(60) Provisional application No. 61/593,149, filed on Jan. 31, 2012.

(51) Int. Cl.

| | |
|---|---|
| ***E02F 3/60*** | (2006.01) |
| ***E02F 3/30*** | (2006.01) |
| ***E02F 3/36*** | (2006.01) |
| ***E02F 3/40*** | (2006.01) |
| ***E02F 3/46*** | (2006.01) |

(52) U.S. Cl.

CPC ..... *E02F 3/308* (2013.01); *E02F 3/3677* (2013.01); *E02F 3/40* (2013.01); *E02F 3/302* (2013.01); *E02F 3/304* (2013.01); *E02F 3/46* (2013.01)

USPC ..... 37/396

(58) Field of Classification Search

CPC ..... E02F 3/304; E02F 3/305; E02F 3/308; E02F 3/425; E02F 3/427; E02F 3/4075; E02F 9/14; E02F 9/2207

USPC ..... 37/195, 396, 398, 344, 345, 446; 414/685, 694, 695, 722, 726, 690

See application file for complete search history.

(56) References Cited

U.S. PATENT DOCUMENTS

| | | | |
|---|---|---|---|
| 2,082,018 | A | 6/1937 | McClain |
| 3,933,260 | A | 1/1976 | Kronlokken et al. |
| 4,044,903 | A | 8/1977 | Baron |
| 4,150,812 | A | 4/1979 | Baron |
| 4,509,895 | A | 4/1985 | Baron |
| 5,251,389 | A | 10/1993 | Bessey |
| 5,408,767 | A | 4/1995 | Hazama et al. |

(Continued)

FOREIGN PATENT DOCUMENTS

| | | |
|---|---|---|
| SU | 651090 | 3/1979 |

OTHER PUBLICATIONS

First Office Action from the Australian Patent Office for Application No. 2013200545 dated Jun. 10, 2014 (5 pages).

*Primary Examiner* — Robert Pezzuto

(74) *Attorney, Agent, or Firm* — Michael Best & Friedrich LLP

(57) ABSTRACT

A mining shovel adapted to dig a bank of material includes a boom having an end, a hoist rope extending over the end of the boom, an elongated member movably coupled to the boom, a dipper for engaging the bank of material, a bail assembly, and a pitch brace. The member includes a first end and a second end. The dipper is coupled to the second end of the member and includes a digging edge. The bail assembly includes a first end pivotably coupled to the dipper and a second end coupled to the hoist rope passing over the boom. The pitch brace includes a first end pivotably coupled to the bail assembly and a second end pivotably coupled to the member.

21 Claims, 9 Drawing Sheets

(56) References Cited

U.S. PATENT DOCUMENTS

| | | | |
|---|---|---|---|
| 5,499,463 | A | 3/1996 | Profio et al. |
| 5,507,352 | A | 4/1996 | Frisbee et al. |
| 5,752,334 | A | 5/1998 | Immel |
| 6,168,542 | B1 | 1/2001 | Chang |
| 6,272,775 | B1 | 8/2001 | Schmidt et al. |
| 6,434,862 | B1 | 8/2002 | Hren |
| 6,484,423 | B1 | 11/2002 | Murray |
| 6,588,126 | B2 | 7/2003 | Leslie et al. |
| 6,970,801 | B2 | 11/2005 | Mann |
| 7,174,826 | B2 | 2/2007 | Kerrigan et al. |
| RE40,869 | E | 8/2009 | Leslie et al. |
| 2008/0213075 | A1 | 9/2008 | Sjogren et al. |
| 2010/0201180 | A1 | 8/2010 | Maynard et al. |

SHOVEL WITH PASSIVE TILT CONTROL

CROSS-REFERENCE TO RELATED APPLICATIONS

This application claims the benefit of U.S. Provisional Patent Application No. 61/593,149, filed Jan. 31, 2012, the entire contents of which are incorporated herein by reference.

BACKGROUND

The present invention relates to the field of mining shovels. Specifically, the present invention relates to mechanisms for controlling the tilt angle of a dipper.

As shown in FIGS. 1 and 2, a conventional electric rope mining shovel includes a dipper 10 rigidly attached to a handle 14, and a pitch brace 18 provides a link between the handle 14 and the dipper 10. The dipper 10 is hoisted through a bank (not shown) by a cable or hoist rope 22 that is attached to a bail 24 and equalizer 26 and passes over a boom sheave 30. The bail 24 is coupled to the dipper 10, and the equalizer 26 is coupled to the bail 24. The dipper 10 includes a lip 34 for engaging the material in the bank. During the hoist phase, the dipper 10 is pulled upward through the bank by the hoist rope 22. The hoist rope 22 exerts a tension force on the dipper 10 through the bail 24 and equalizer 26, and the equalizer 26 maintains the tension force in an orientation that is tangent to the boom sheave 30.

SUMMARY

In a conventional shovel, the set length of the pitch brace 18 impacts the performance of the dipper 10 under various digging conditions. For instance, a longer pitch brace length provides better penetration at the toe of the bank if the digging face is hard. However, with the longer pitch brace 18, the lip 34 positioned on the front edge of the dipper 10 is angled in a mostly horizontal direction, and the fill factor, or the percentage of the dipper 10 that is filled, is low. Alternatively, when the pitch brace 18 is set to a shorter length, the lip 34 is angled in a mostly vertically direction. In this case the fill factor may be high, but the dipper 10 suffers from poor penetration of the bank. A short pitch brace 18 is typically used for digging softer material.

In one embodiment, the invention provides a mining shovel adapted to dig a bank of material. The mining shovel includes a boom having an end, a hoist rope extending over the end of the boom, an elongated member movably coupled to the boom, a dipper for engaging the bank of material, a bail assembly, and a pitch brace. The member includes a first end and a second end. The dipper is coupled to the second end of the member and includes a digging edge. The bail assembly includes a first end pivotably coupled to the dipper and a second end coupled to the hoist rope passing over the boom. The pitch brace includes a first end pivotably coupled to the bail assembly and a second end pivotably coupled to the member.

In another embodiment, the invention provides a dipper assembly for a mining shovel. The mining shovel includes a boom, a member movably coupled to the boom, and a hoist rope passing over an end of the boom. The dipper assembly includes a dipper, a bail, and a pitch brace. The dipper is adapted to be coupled to an end of the member and includes a digging edge. The bail includes a first end pivotably coupled to the dipper and a second end adapted to be coupled to the hoist rope passing over the end of the boom. The pitch brace includes a first end pivotably coupled to the bail and a second end adapted to be pivotably coupled to the member.

In yet another embodiment, the invention provides a mining shovel including a boom, a member movably coupled to the boom, a dipper body positioned at an angle relative to the handle, a bail assembly, and a mechanism for changing an angle of the dipper body relative to the handle during a digging operation. The boom includes an end and a hoist rope extending over the end. The member includes a first end and a second end. The dipper body is pivotably coupled to the second end of the member at a first joint and includes a digging edge. The dipper body is positioned at an angle relative to the member. The bail assembly includes a first end pivotably coupled to the dipper body at a second joint and a second end coupled to the hoist rope passing over the boom. The mechanism for changing the angle of the dipper body relative to the member includes a first link, a second link, a third link, and a fourth link. The first link is defined by a portion of the dipper extending between the first joint and the second joint. The second link is pivotably coupled to the bail assembly at a third joint and is pivotably coupled to the member at a fourth joint. The third link is defined by a portion of the bail assembly extending between the second joint and the third joint. The fourth link is defined by a portion of the member extending between the fourth joint and the first joint.

In still another embodiment, the invention provides bail assembly for a mining shovel. The shovel includes a boom, a hoist rope passing over an end of the boom, a member movably coupled to the boom, a dipper coupled to an end of the member, and a pitch brace coupled to the member. The bail assembly includes a first end pivotably coupled to the dipper, a second end coupled to the hoist rope passing over the end of the boom, and a brace joint pivotably coupled to the pitch brace.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

Figure 3:
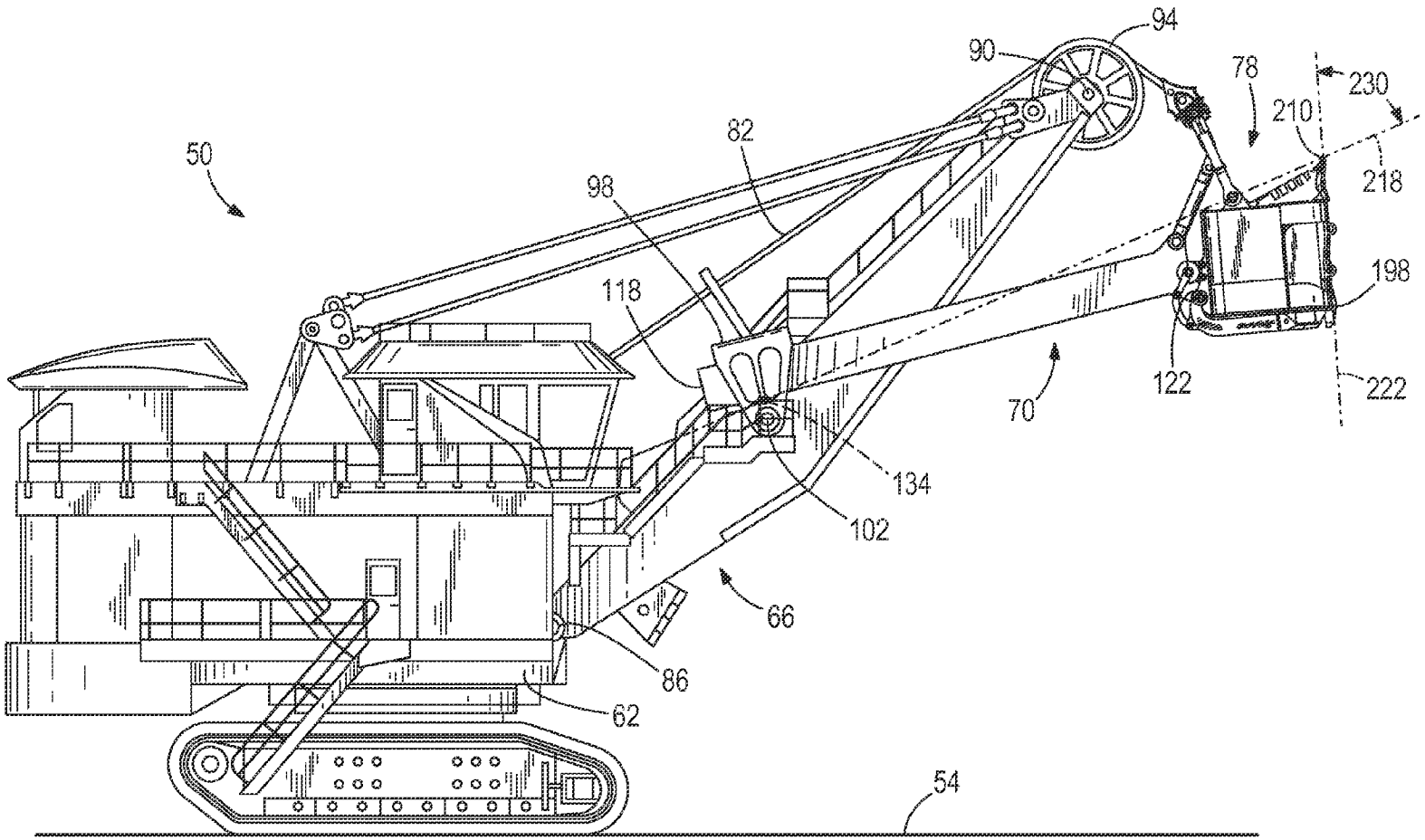
FIG. 3 is a side view of a mining shovel.

As shown in FIG. 3, a mining shovel 50 rests on a support surface, or floor 54, and includes a base 62, a boom 66, an elongated member or handle 70, and a dipper assembly 78. The base 62 includes a hoist drum (not shown) for reeling in and paying out a cable, or hoist rope 82. The boom 66 includes a first end 86 coupled to the base 62, a second end 90 opposite the first end 86, a boom sheave 94, a saddle block 98, and a shipper shaft 102. The boom sheave 94 is coupled to the second end 90 of the boom 66 and guides the rope 82 over the second end 90. The rope 82 is coupled to the dipper assembly 78. The dipper assembly 78 is raised or lowered as the rope 82 is reeled in or paid out, respectively, by the host drum. The saddle block 98 is rotatably coupled to the boom 66 by the shipper shaft 102, which is positioned between the first end 86 and the second end 90 of the boom 66 and extends transversely through the boom 66. The handle 70 is moveably coupled to the boom 66 by the saddle block 98.

Figure 4:
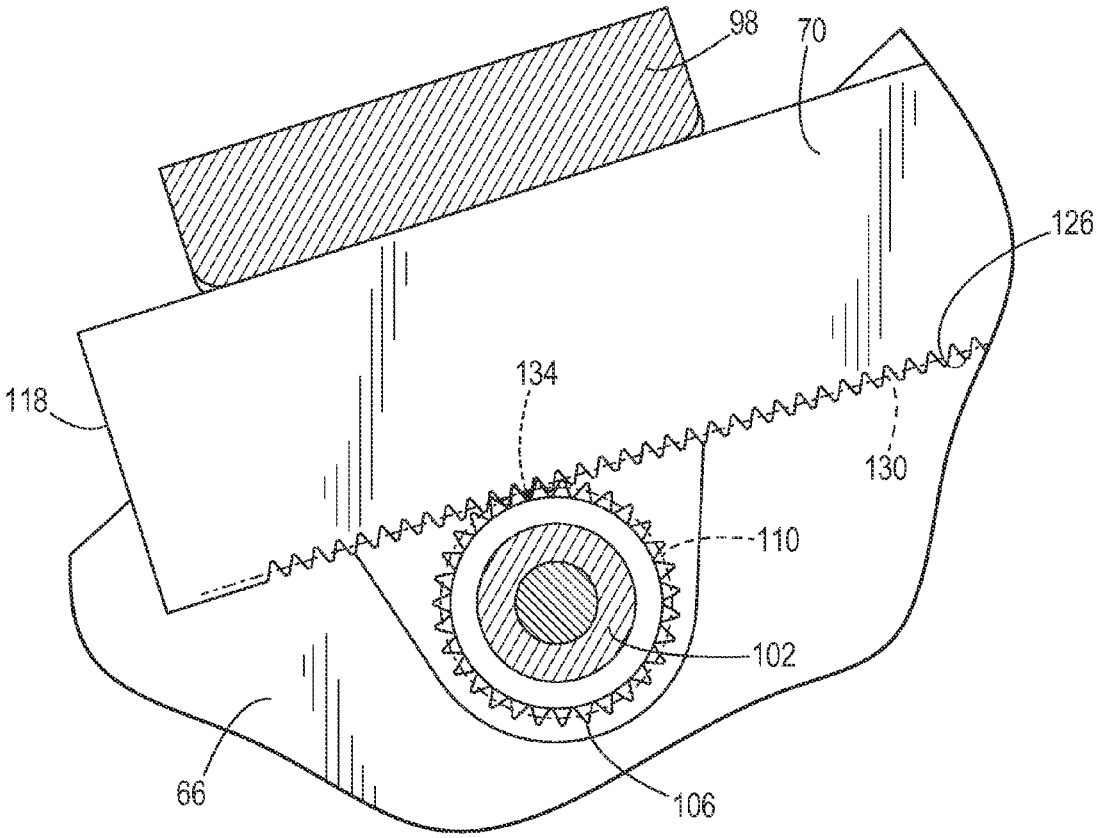
FIG. 4 is an enlarged side view of a portion of the mining shovel of FIG. 1 with a saddle block removed.

As shown in FIGS. 3 and 4, the handle 70 includes a first end 118, a second end 122 (FIG. 3), and a rack 126 (FIG. 4). The first end 118 of the handle 70 is moveably received in the saddle block 98, and the handle 70 passes through the saddle block 98 such that the handle 70 is configured for rotational and translational movement relative to the boom 36 (FIG. 3). Stated another way, the handle 70 is linearly extendable relative to the saddle block 98 and is rotatable about the shipper shaft 102.

As shown in FIG. 4, the shipper shaft 102 includes a spline pinion 106 defining a pitch circle 110. The rack 126 engages the spline pinion 106, and rotation of the shipper shaft 102 facilitates translational movement of the handle 70 via a rack and pinion mechanism. That is, rotation of the shipper shaft 102 causes the spline pinion 106 to move the rack 126, extending and retracting the handle 70 relative to the boom 66. The rack 126 defines a pitch line 130, and the point on the pitch circle 110 at which the pinion 106 engages the rack 126 defines a pitch point 134. As the handle 70 is extended and retracted, the pitch point 134 moves along the pitch line 130. The pitch point 134 represents the point about which the handle 70 generally rotates relative to the boom 66.

Figure 1:
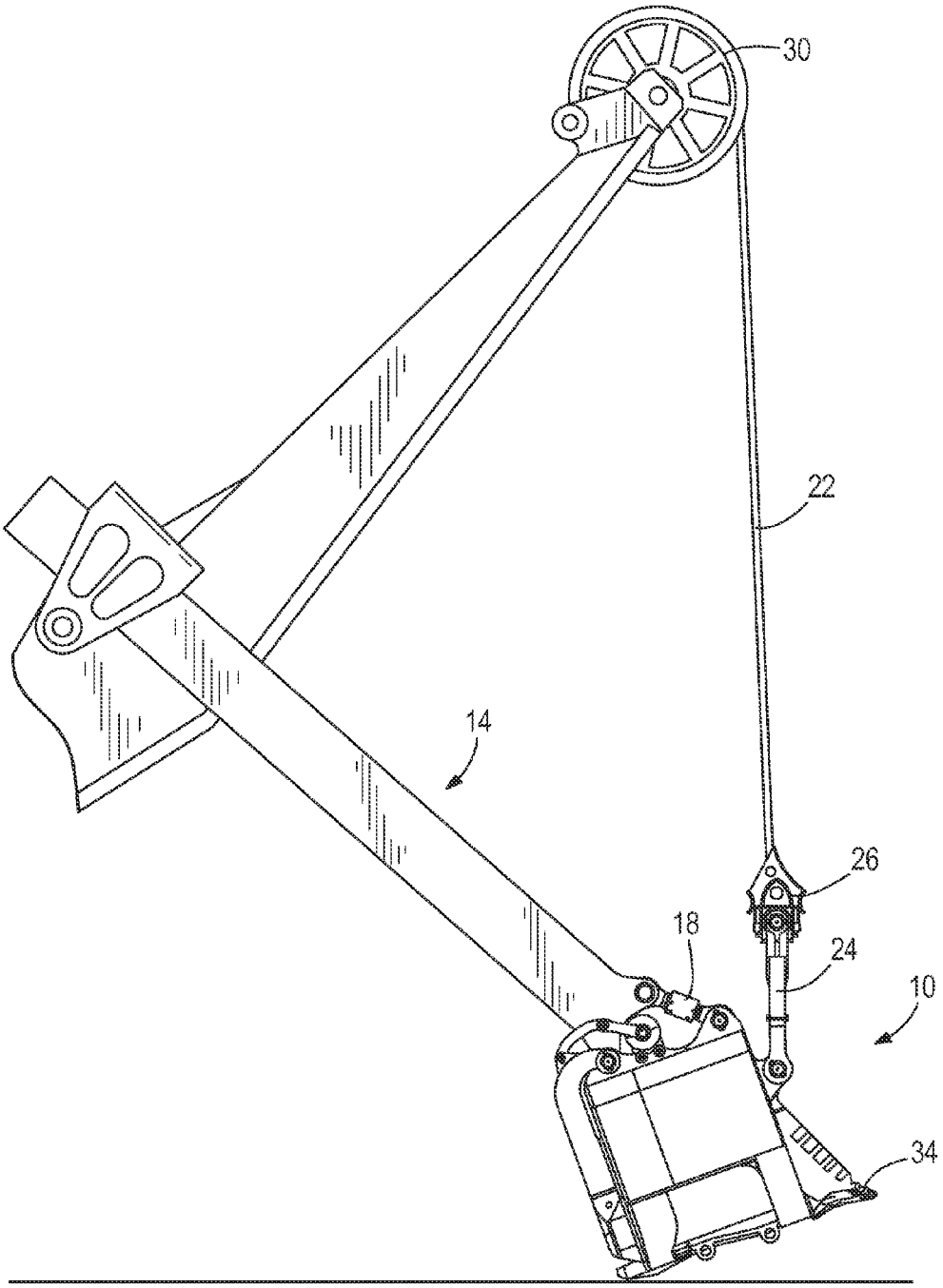
FIG. 1 PRIOR ART
FIG. 1 (prior art) is a side view of a portion of a mining shovel.
Figure 5:
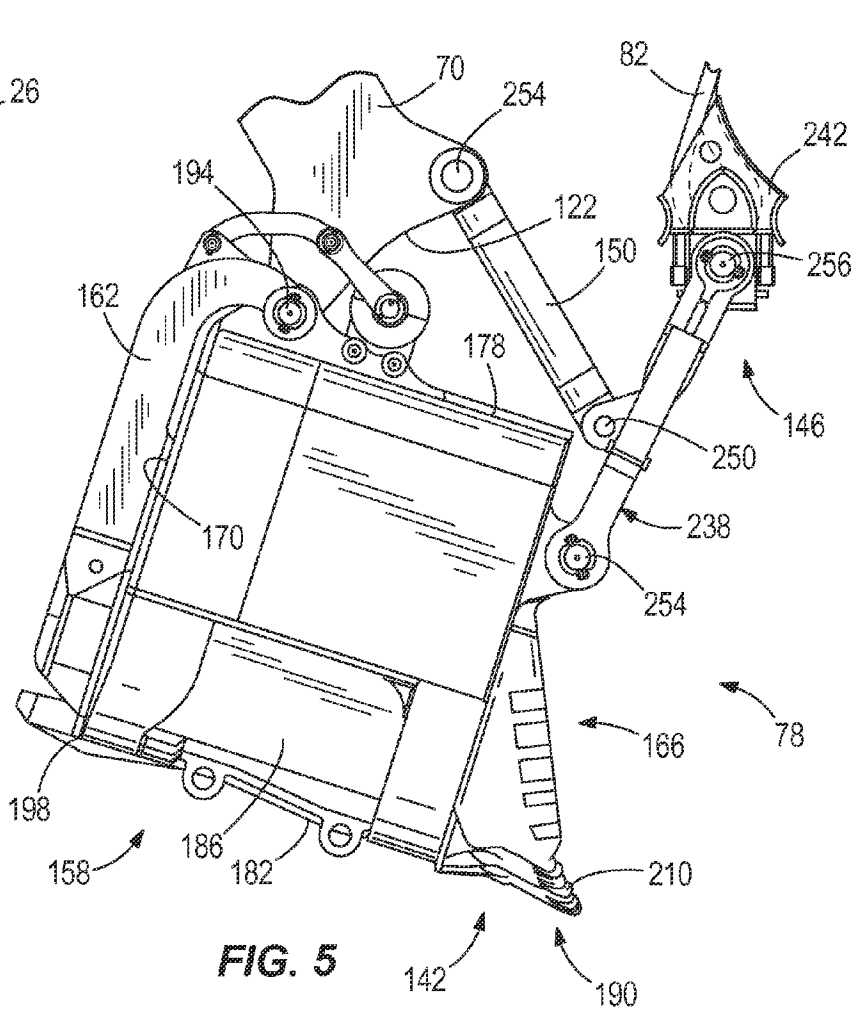
FIG. 5 is a side view of a dipper assembly.
Figure 2:
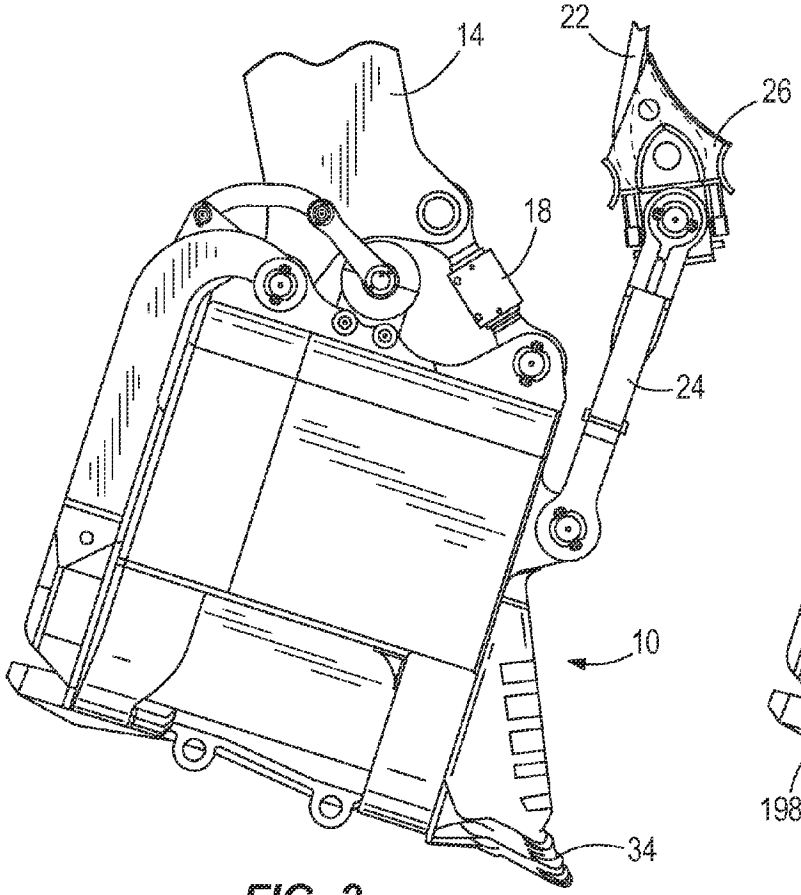
FIG. 2 PRIOR ART
FIG. 2 (prior art) is a side view of a dipper assembly.
Figure 6:
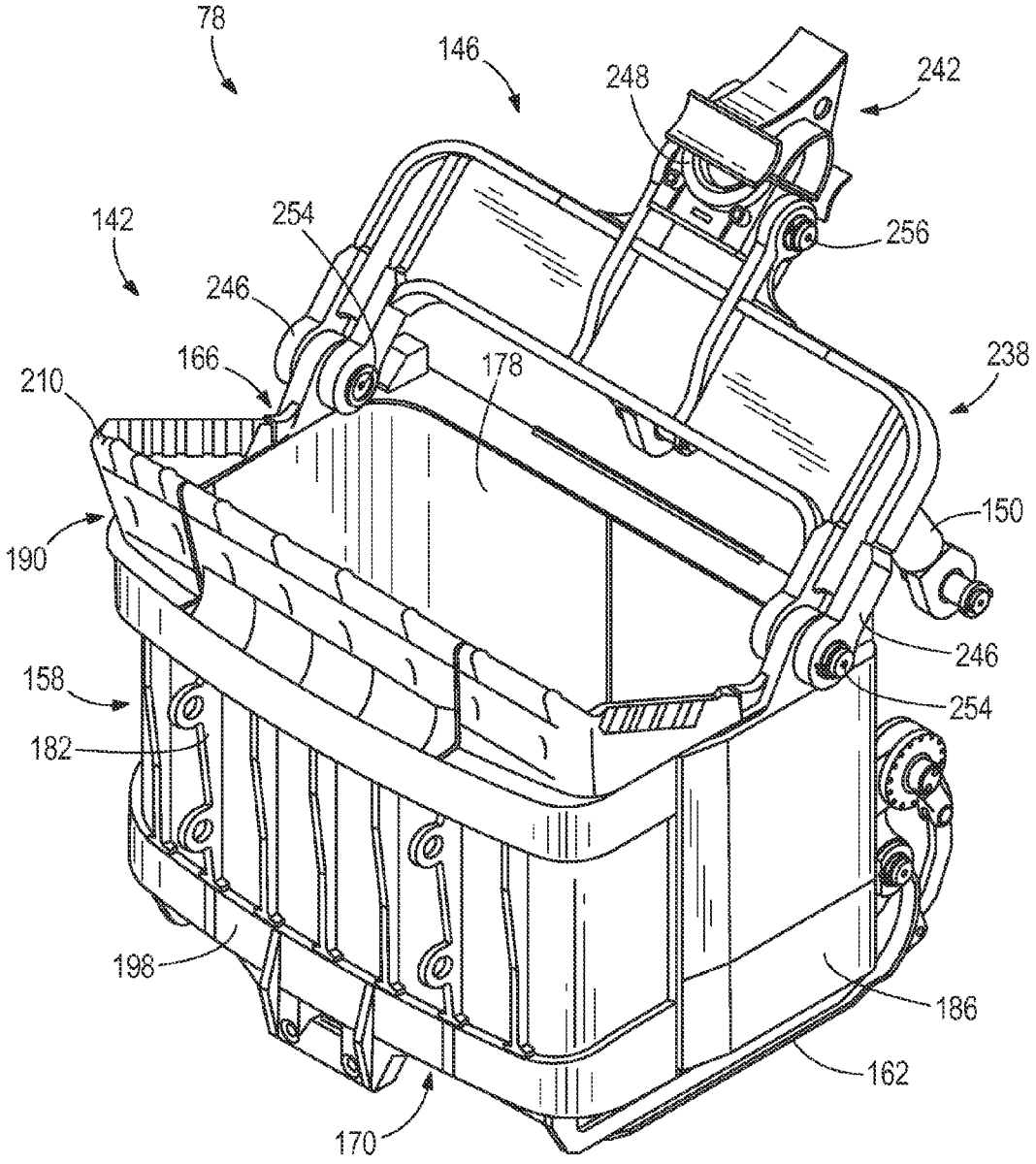
FIG. 6 is a perspective view of a dipper, a bail, and an equalizer.

Referring to FIGS. 5 and 6, the dipper assembly 78 includes a dipper 142, a bail assembly 146, and a pitch brace 150. The dipper 142 includes a dipper body 158 and a dipper door 162. In one embodiment, the dipper body 158 has a substantially rectangular, hollow cross-section for carrying material (FIG. 6). The dipper body 158 includes a receiving end 166 for receiving material within the dipper body 158, and a discharging end 170. The dipper body 158 includes a top wall 178, a bottom wall 182 opposite the top wall 178, and two side walls 186 (only one of which is shown in FIG. 5). The top wall 178 is pivotably coupled to the second end 122 of the handle 70 at a first joint or a ground joint 194. In the illustrated embodiment, the ground joint 194 is a pin connection. The bottom wall 182 includes a lip 190 proximate the receiving end 166 and a heel 198 proximate the discharging end 170. The lip 190 defines a digging edge 210. Multiple teeth (not shown) are coupled to the digging edge 210. The dipper door 162 is pivotably coupled to the top wall 178 and releasably attached to the bottom wall 182. When a latch (not shown) is triggered, the dipper door 162 rotates toward the handle 70, discharging the material within the dipper body 158. In the illustrated embodiment, the door 162 is pivotably coupled about a joint that is located along the same axis as the ground joint 194. In other embodiments, the door 162 pivots about an axis that that is not coaxial with the ground joint 194.

Referring to FIG. 6, the bail assembly 146 includes a bail 238 and an equalizer 242. In other embodiments, the bail assembly 146 may include only a bail, only an equalizer, or another type of combination bail and equalizer. In the illustrated embodiment, the bail 238 has a clevis shape including two ends 246. Each end 246 is pivotably coupled to one of the side walls 186 of the dipper body 158 by a second joint or bail joint 254 positioned proximate the receiving end 166. In the illustrated embodiment, the bail joint 254 is a pin connection. The equalizer 242 is pivotably coupled to the bail 238 about an equalizer pin 256. The equalizer 242 includes a partial sheave 248 having a rounded edge. The rope 82 (FIG. 5) wraps around the partial sheave 248, tethering the equalizer 242 to the boom sheave 94. During a dig cycle, the equalizer 242 articulates with respect to the bail 238 such that the rope 82 remains tangent with respect to the boom sheave 94 without causing undesired tilting of the dipper 142. The equalizer 242 prevents the rope 82 from kinking and accounts for slack conditions.

As best shown in FIG. 5, the pitch brace 150 is pivotably coupled to the bail 238 at a third joint or brace joint 250 and is pivotably coupled to the handle 70 at a fourth joint or handle joint 254 proximate the second end 122 of the handle 70. In the illustrated embodiment, the brace joint 250 is located between the bail joint 254 and the equalizer pin 256, and the pitch brace 150 has a fixed length. Also, in the illustrated embodiment, the brace joint 250 and the handle joint 254 are pin connections. In other embodiments, the pitch brace 150 may have an adjustable length.

Referring again to FIG. 3, a rake line 218 is defined as the line extending between the pitch point 134 and the digging edge 210. A tooth line 222 extends from the heel 198 through the digging edge 210. The angle between the rake line 218 and the tooth line 222 defines a rake angle 230. Generally, the rake angle 230 is indicative of the relative relationship between the digging edge 210 of the dipper 142 and the handle 70 for a given extension length of the handle 70.

Figure 7:
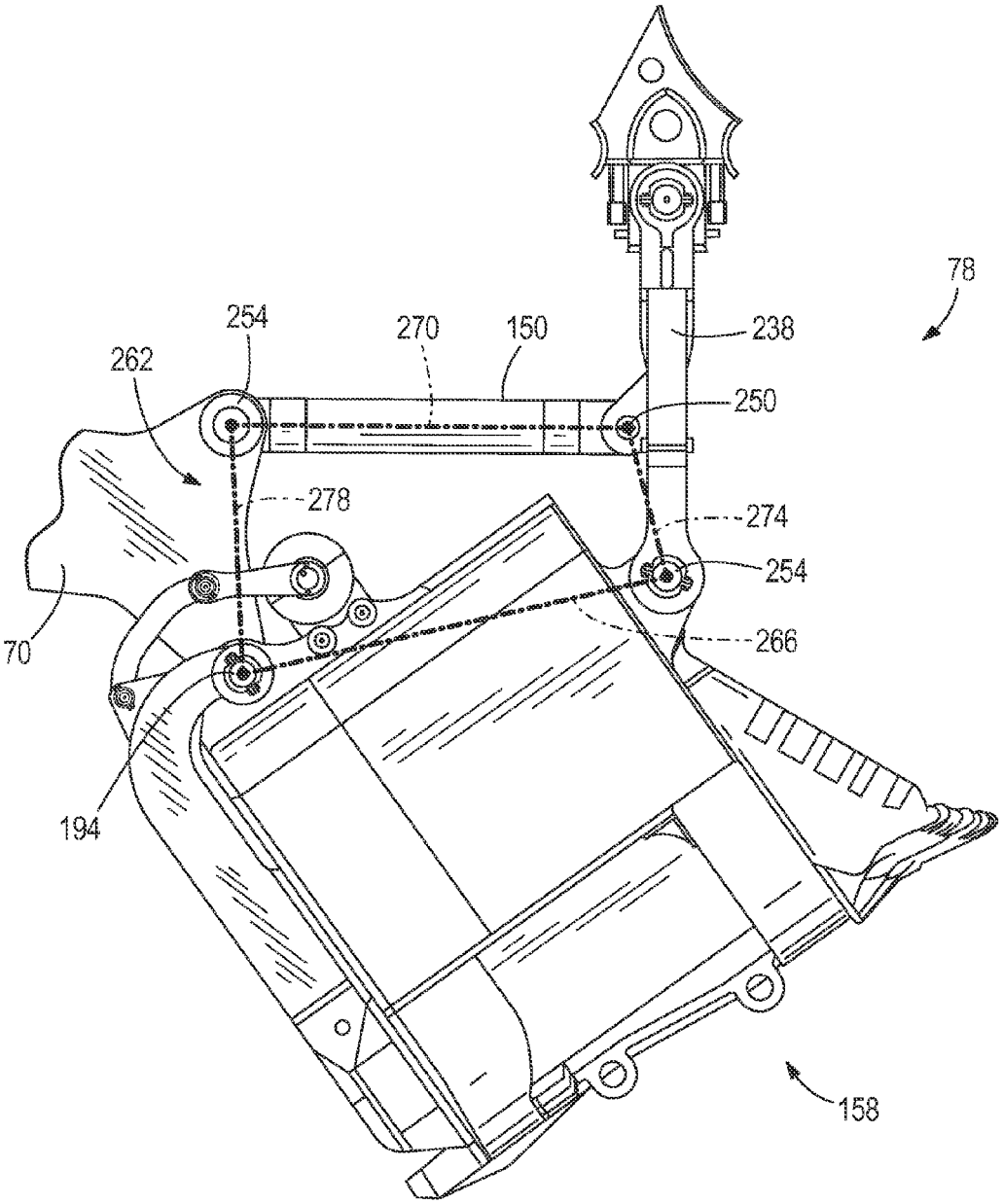
FIG. 7 is a side view of the dipper assembly of FIG. 5 showing a four bar linkage.

As illustrated in FIG. 7, the dipper assembly 78 provides a four bar linkage 262 for controlling the rake angle 230 (FIG. 3) during a dig cycle. More specifically, the linkage 262 permits the rake angle 230 to change during a dig operation without extending the handle 70 relative to the boom 66 (i.e., the handle 70 remains at a fixed extension length). The four bar linkage 262 comprises a first link or follower link 266, a second link or coupler link 270, a third link or input link 274, and a fourth link or ground link 278. The follower link 266 is defined by the portion of the dipper body 158 between the ground joint 194 and the bail joint 254. The coupler link 270 is defined by the pitch brace 150, extending between the brace joint 250 and the handle joint 254. The input link 274 is defined by the portion of the bail 238 between the bail joint 254 and the brace joint 250. The ground link 278 is defined by the portion of the handle 70 between the handle joint 254 and the ground joint 194.

Figure 8:
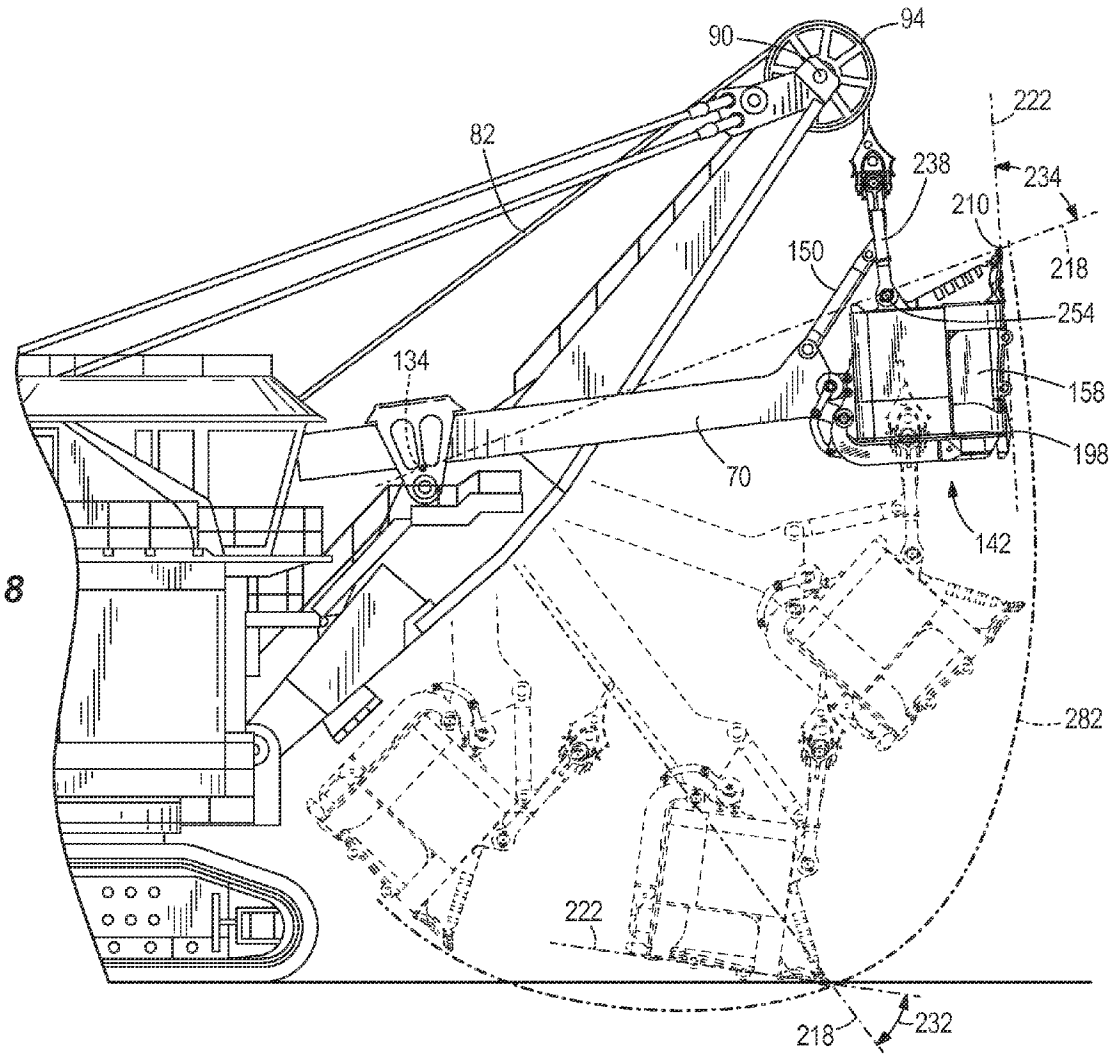
FIG. 8 is a side view of a portion of the mining shovel of FIG. 3 during a dig cycle.

FIG. 8 shows an example of a dig cycle, including the profile 282 of the digging edge 210 during the cycle. Starting at the tuck position (shown in phantom lines at bottom left), the dipper 142 is crowded, or moved into the bank of material (bottom center). The dipper 142 is then hoisted through the bank (right center and top right). Although the extension of the handle 70 varies slightly during the crowd phase in the illustrated cycle, the positive effect of the four bar linkage 262 (FIG. 7) on the orientation of the dipper 142 is evident.

As the dipper 142 is crowded into the bank (bottom center of FIG. 8), the dipper 142 is oriented at a slight downward angle, permitting better penetration of the base, or toe, of the bank by teeth (not shown) coupled to the digging edge 210. In this orientation, the initial rake angle 232 is relatively small. As the dipper 142 enters the bank, the rope 82 is reeled in by the hoist drum to raise, or hoist, the dipper 142 through the bank (see the position of the handle 70 in the center right of FIG. 8). During the hoist phase, the pitch brace 150 transmits a moment created about the bail joint 254, causing the dipper body 158 to tilt away from the bank. The rotation of the dipper body 158 results in a final rake angle 234 (top right of FIG. 8) that is larger than the initial rake angle 232. This allows the dipper 142 to catch the sloughing material that is liberated from the bank and provides a better fill factor for the dipper 142.

The tension acting between the boom sheave 94 and the bail 238 acts along a line of action defined by the rope 82. Due to the equalizer 242, the rope 82 (and therefore the tension) remains substantially tangent to the boom sheave 94. The bail 238 also tends to remain aligned along a line that is substantially tangent to the boom sheave 94, although the bail 238 may deviate due to the reaction force created by the bank on the dipper 142. As shown in FIG. 8, the tension creates a first moment on the input link 274 (that is, the bail 238) about the bail joint 254 during the crowd and hoist phases. For instance, during the hoist phase the first moment acts in a clockwise direction in the illustration of FIG. 8. The pitch brace 150 provides a reaction force inducing a second moment on the dipper body 158 about the ground joint 194. The second moment acts in an opposite direction of the first moment. This causes the follower link 266 (that is, the dipper body 158) to rotate about the ground joint 194. As a result, the dipper 142 rotates away from the bank (counter-clockwise in the illustration of FIG. 8), increasing the rake angle 230. Increasing the rake angle 230 allows material from the bank to fill in the rear portion of the dipper 142, or the portion near the top wall 178 (FIG. 6).

The four bar linkage 262 harnesses the moments created by the motion of the bail 238 during a dig cycle to control changes in the rake angle 230 without the use of motors or actuators. The bail 238 is attached to the rope 82 by the equalizer 242, without any additional cables or actuators to tilt the dipper 142. The linkage 262 utilizes the tension generally acting along a single line of action of the hoist rope 82 to control the rake angle 230 during a digging operation. The dipper body 158 is rotated from a substantially horizontal orientation in an initial stage of the dig cycle to a substantially vertical orientation in a later stage of the dig cycle. The initial position has a relatively small rake angle 230 that facilitates penetration by the digging edge 210 into the toe of the bank during the crowding phase, and the rake angle 230 increases during the dig cycle to permit the dipper body 158 to receive a greater portion of the material and achieve a better fill factor. In this way, the linkage 262 controls the behavior of the dipper 142 to optimize both the penetration force of the digging edge 210 and the fill factor of the dipper 142.

The lengths of the links of the four bar linkage 262 shown in FIG. 7 may be altered in order to optimize the initial penetration force and the fill factor. The linkage 262 may be customized based on the behavior of the handle 70 during digging and the type of material that is being dug. The size of each link can be changed independent of the other links, and the relative sizes of the links are not limited to the arrangement shown in the illustrated embodiment. In addition, the behavior of the handle 70 and dipper 142 are affected by the size, geometry, and relative positioning of the shipper shaft 102, the second boom end 90, and the boom sheave 94 (FIG. 3). These components define the dig envelope 282 and can be modified to optimize the behavior of the dipper 142.

Figure 9:
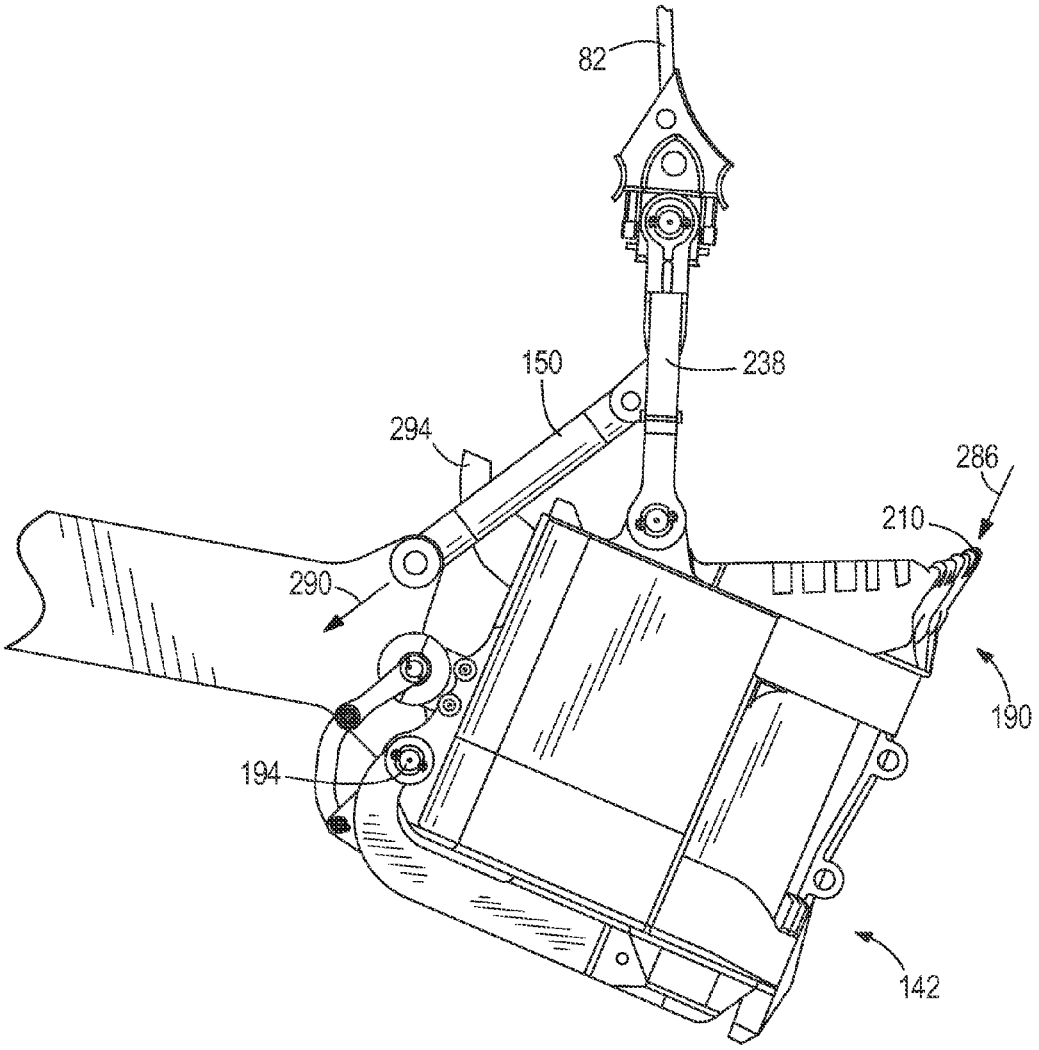
FIG. 9 is a side view of a dipper assembly during a hoist operation.

The four bar linkage 262 improves the penetration force during the digging cycle. As shown in FIG. 9, the bank exerts a reaction force 286 on the dipper lip 190 as the dipper moves upward through the bank. This reaction force 286 induces a moment about the ground joint 194, tending to rotate the dipper 142 clockwise. However, the pitch brace 150 provides a reaction force 290 that creates a moment acting against the reaction force 286. The pitch brace 150 thereby assists the digging edge 210, improving the breakout force of the digging edge 210 and teeth and facilitating the movement of the dipper 142 through the bank.

FIG. 9 also illustrates that the top wall 178 of the dipper 142 may include a bail stop 294. The bail stop 294 contacts the bail 238 and prevents the bail 238 from over-rotating, or rotating past a desired point relative to the dipper 142.

Figure 10:
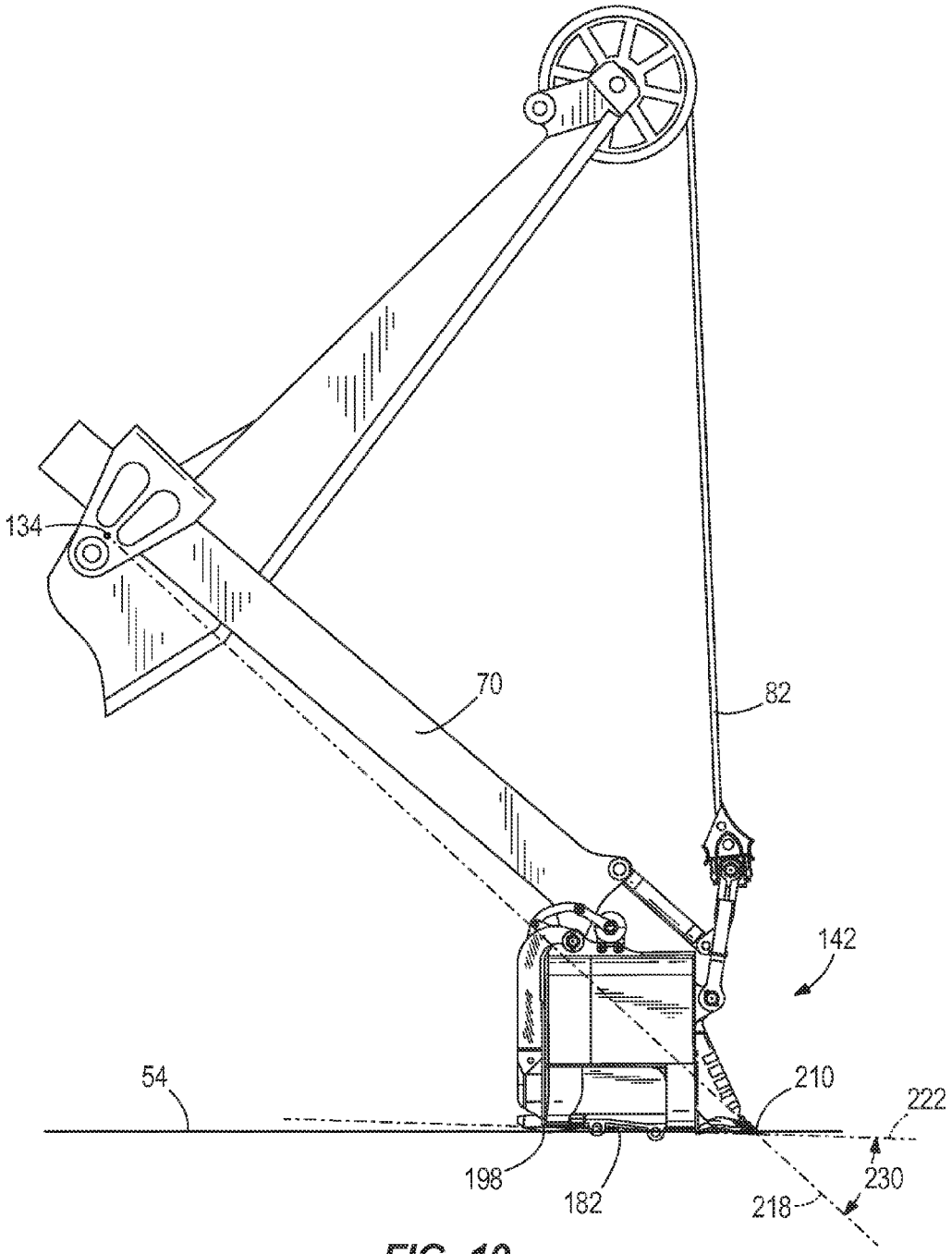
FIG. 10 is a side view of a portion of the mining shovel of FIG. 1 with the dipper resting on the ground.

As shown in FIG. 10, the linkage 262 permits the dipper 142 to lie on the floor 54 such that the bottom wall 182 is flat against the floor 54. This configuration allows the dipper 142 to perform a "clean up" operation in which the dipper 142 levels a portion of the support surface 54. In this condition, the dipper 142 is substantially horizontal, and the rake angle 230 is relatively small. Although not shown in FIG. 10, in alternative embodiments the bail 238 and the equalizer 242 are aligned in a straight line with the rope 82 when the bottom wall 182 of the dipper 142 rests on the ground 54.

Although the invention has been described in detail with reference to certain preferred embodiments, variations and modifications exist within the scope and spirit of one or more independent aspects of the invention as described.

Thus, the invention provides, among other things, a shovel with passive tilt control. Various features and advantages of the invention are set forth in the following claims.

What is claimed is:

1. A mining shovel adapted to dig a bank of material, the mining shovel comprising:

a boom including an end;

a hoist rope extending over the end of the boom;

an elongated member including a first end and a second end, the member being movable relative to the boom;

a dipper for engaging the bank of material, the dipper being coupled to the second end of the member, the dipper including a digging edge;

a bail assembly including a first end pivotably coupled to the dipper and a second end coupled to the hoist rope passing over the boom;

a pitch brace including a first end pivotably coupled to the bail assembly and a second end pivotably coupled to the member; and wherein the first end of the pitch brace is pivotably coupled to the bail assembly between the first end of the bail assembly and the second end of the bail assembly.

2. The mining shovel of claim 1, wherein the hoist rope exerts a hoist force, and wherein the bail includes a first side and a second side, wherein the hoist force exerted on each side of the bail is equal as the bail is hoisted.

3. The mining shovel of claim 1, wherein the dipper pivots relative to the second end of the member as the dipper is hoisted through the bank of material.

4. The mining shovel of claim 1, wherein the member is translationally movable relative to the boom via a rack and pinion mechanism.

5. The mining shovel of claim 1, wherein the member is pivotably coupled to the boom about a transverse shaft extending through the boom.

6. The mining shovel of claim 5, wherein the dipper includes a material receiving opening, a material discharging opening opposite the material receiving opening, and a wall extending therebetween, the digging edge being positioned proximate the material discharging opening, a heel edge being positioned along the wall and proximate the material discharging opening, wherein an axis extending between the heel edge and the digging edge defines a tooth line.

7. The mining shovel of claim 6, wherein the member engages the transverse shaft at a pitch point, and wherein an axis extending between the pitch point and the digging edge defines a rake line, the rake line intersecting the tooth line to form a rake angle.

8. The mining shovel of claim 7, wherein the hoist rope exerts a tension force on the bail assembly, the tension force inducing a moment on the bail assembly about the first end of the bail assembly, the pitch brace exerting a reaction force to rotate the dipper relative to the second end of the member, the rotation of the dipper causing the rake angle to change.

9. The mining shovel of claim 1, wherein the hoist rope is coupled to the bail via an equalizer that is pivotably coupled to the bail.

10. The mining shovel of claim 1, wherein the orientation of the digging edge relative to the elongated member is automatically changed as the dipper is hoisted by the hoist rope.

11. A dipper assembly for a mining shovel, the mining shovel including a boom, a member movable relative to the boom, and a hoist rope passing over an end of the boom, the dipper assembly comprising:

a dipper adapted to be coupled to an end of the member, the dipper including a digging edge;

a bail including a first end pivotably coupled to the dipper and a second end adapted to be coupled to the hoist rope passing over the end of the boom;

a pitch brace including a first end pivotably coupled to the bail and a second end adapted to be pivotably coupled to the member, and wherein the first end of the pitch brace is pivotably coupled to the bail between the first end of the bail and the second end of the bail.

12. The dipper assembly of claim 11, wherein the hoist rope exerts a tension force on the bail inducing a moment on the bail about the first end of the bail, the pitch brace exerting a reaction force that induces the dipper to rotate relative to the second end of the member.

13. The dipper assembly of claim 12, wherein the bail is coupled to the hoist rope via an equalizer pivotably coupled to the bail.

14. The dipper assembly of claim 11, wherein the pitch brace has a fixed length.

15. The dipper assembly of claim 11, wherein the dipper rotates relative to the second end of the member as the dipper is hoisted through the bank of material.

16. The dipper assembly of claim 11, wherein the hoist rope exerts a hoist force, and wherein the bail includes a first side and a second side, wherein the hoist force exerted on each side of the bail is equal as the bail is hoisted.

17. A mining shovel comprising:

a boom including an end and a hoist rope extending over the end;

a member including a first end and a second end, the member being movable relative to the boom;

a dipper body pivotably coupled to the second end of the member at a first joint, the dipper body including a digging edge, the dipper body positioned at an angle relative to the member;

a bail assembly including a first end pivotably coupled to the dipper body at a second joint and a second end coupled to the hoist rope passing over the boom; and a mechanism for changing the angle of the dipper body relative to the member during a digging operation, the mechanism including a first link defined by a portion of the dipper extending between the first joint and the second joint, a second link pivotably coupled to the bail assembly at a third joint and pivotably coupled to the member at a fourth joint, a third link defined by a portion of the bail assembly extending between the second joint and the third joint, and a fourth link defined by a portion of the member extending between the fourth joint and the first joint.

18. The mining shovel of claim 17, wherein as the dipper body is hoisted through a bank of material to be dug, the dipper body rotates relative to the member in opposition to a reaction force exerted by the bank on the digging edge.

19. The mining shovel of claim 17, wherein the hoist rope exerts a tension force on the bail assembly, thereby inducing a moment on the third link about the second joint, the second link exerting a reaction force causing the first link to rotate about the first joint.

20. The mining shovel of claim 17, wherein the member is rotatable relative to the boom about a pivot point, wherein the dipper includes a material receiving opening, a material discharging opening opposite the material receiving opening, a wall extending therebetween, and a heel edge positioned along the wall and proximate the material discharging opening, wherein the digging edge being positioned proximate the material discharging opening such that an axis extending between the pivot point and the digging edge defines a rake line, and an axis extending between the heel edge and the digging edge defines a tooth line intersecting the rake line, the angle of the dipper body being defined by an angle between the rake line and the tooth line.

21. The mining shovel of claim 17, wherein the hoist rope is coupled to the bail via an equalizer that is pivotably coupled to the bail.

* * * * *